United States Patent [19]

Lanese

[11] 4,245,402

[45] Jan. 20, 1981

[54] FIREARM SIGHT PICTURE SIMULATOR AND TEACHING AID

[76] Inventor: Richard A. Lanese, 6 Summit La., New Hyde Park, N.Y. 11040

[21] Appl. No.: 966,966

[22] Filed: Dec. 6, 1978

[51] Int. Cl.[3] ..... F41F 27/00

[52] U.S. Cl. ..... 434/19; 273/310

[58] Field of Search ..... 35/25; 273/101.2, 313–316; 352/39, 95

[56] References Cited

U.S. PATENT DOCUMENTS

| | | | |
|---|---|---|---|
| 751,591 | 2/1904 | Whiteside | 273/101.2 |
| 936,419 | 10/1909 | Cummings | 273/101.2 |
| 1,007,154 | 10/1911 | Stebbins et al. | 273/101.2 |
| 1,015,391 | 1/1912 | Mitchell | 273/101.2 |
| 1,217,376 | 2/1917 | Wedgwood | 273/101.2 |
| 1,323,841 | 12/1919 | Cummings | 273/101.2 |
| 2,268,113 | 12/1941 | Fidelman | 35/25 |
| 2,319,787 | 5/1943 | Black | 35/25 |
| 2,510,413 | 6/1950 | Paige | 35/25 |
| 2,645,037 | 7/1953 | Talone | 35/25 |
| 2,922,233 | 1/1960 | Yoshikawa | 35/25 |
| 3,545,759 | 12/1970 | Stossl | 35/25 X |

FOREIGN PATENT DOCUMENTS

| | | | |
|---|---|---|---|
| 88479 | 5/1958 | Netherlands | 35/25 |

*Primary Examiner*—Robert W. Michell
*Assistant Examiner*—Thomas J. Wallen
*Attorney, Agent, or Firm*—Bauer & Amer

[57] ABSTRACT

A firearm sight picture simulator and teaching aid provides a sight arm carrying front and rear sights in the manner of a firearm barrel and pivotally adjustable along perpendicular planes such that the pivotal adjustment of the sight arm is automatically positionally retained to permit subsequent verification of proper sight picture alignment.

9 Claims, 3 Drawing Figures

FIREARM SIGHT PICTURE SIMULATOR AND TEACHING AID

The present invention relates to an apparatus for teaching proper firearm sight picture alignment.

When training a beginning firearm shooter in marksmanship, knowledgeable instruction in proper alignment of the firearm's front and rear sights relative to the target and close supervision as the beginner practices the same are essential to the development of good target sighting habits. The instructor, however, is never really certain that the student really understands the correct positioning of the front and rear sights with respect to the target, typically a bull's-eye or the like, since it is not possible for the instructor to sight, simultaneously with the student, through the sights of the aimed firearm. So many other factors and variables can affect the accuracy of a shot that even an examination of the grouping of a series of shots fired at the target by the student is not necessarily indicative of the extent or degree of his success in mastering and utilizing a correct sight picture alignment.

Accordingly, the prior art teaches a number of devices for facilitating instruction of proper sight picture alignment. Some of the disclosures, such as U.S. Pat. Nos. 2,510,413 to Paige and 2,922,233 to Yoshikawa, require the use of an operative firearm together therewith and consequently present accompanying risks and dangers inherent when a neophyte or beginner handles guns. Others, such as U.S. Pat. No. 2,268,113 to Fidelman, which may utilize either a rifle or a simulation thereof, and U.S. Pat. No. 2,645,037 to Talone, provide complex or excessively large and unwieldy structures not suitable for easy portability and use.

On the other hand, U.S. Pat. No. 2,319,787 to Black, which does not require the use of a firearm and is substantially compact and portable, teaches a device which includes a front sight adjustable only along the vertical plane and a separately mounted rear sight movable only along the horizontal plane. Black thus fails to provide the student with a realistic simulation of the actual multi-planar relative adjustability of both front and rear sights on a firearm in attaining proper sight picture alignment.

It is, therefore, the desideratum of the present invention to facilitate the teaching of proper firearm sight picture alignment. Specifically, it is an object of the invention to provide an apparatus having adjustable front and rear sights selectively movable for alignment with a fixed target in the manner of aiming a firearm.

It is another object of the invention to provide means on such apparatus for retaining the selected adjustment of the movable front and rear sights such that their alignment relative to a fixed target may be subsequently verified.

It is a further object of the present invention to provide an apparatus as described wherein the selected adjustment of the movable front and rear sights is automatically retained during such adjustment and without further action on the part of the user.

It is still another object of the invention to provide apparatus which is extremely simple in construction and operation and which is particularly compact and durable such that the apparatus is rendered easily and advantageously portable.

Further objects, features and advantages of the present invention will be more fully appreciated by reference to the following detailed description of a presently preferred, but nonetheless illustrative, embodiment in accordance with the present invention when taken in conjunction with the accompanying drawings, wherein.

DETAILED DESCRIPTION OF THE PREFERRED EMBODIMENTS

Figure 1:
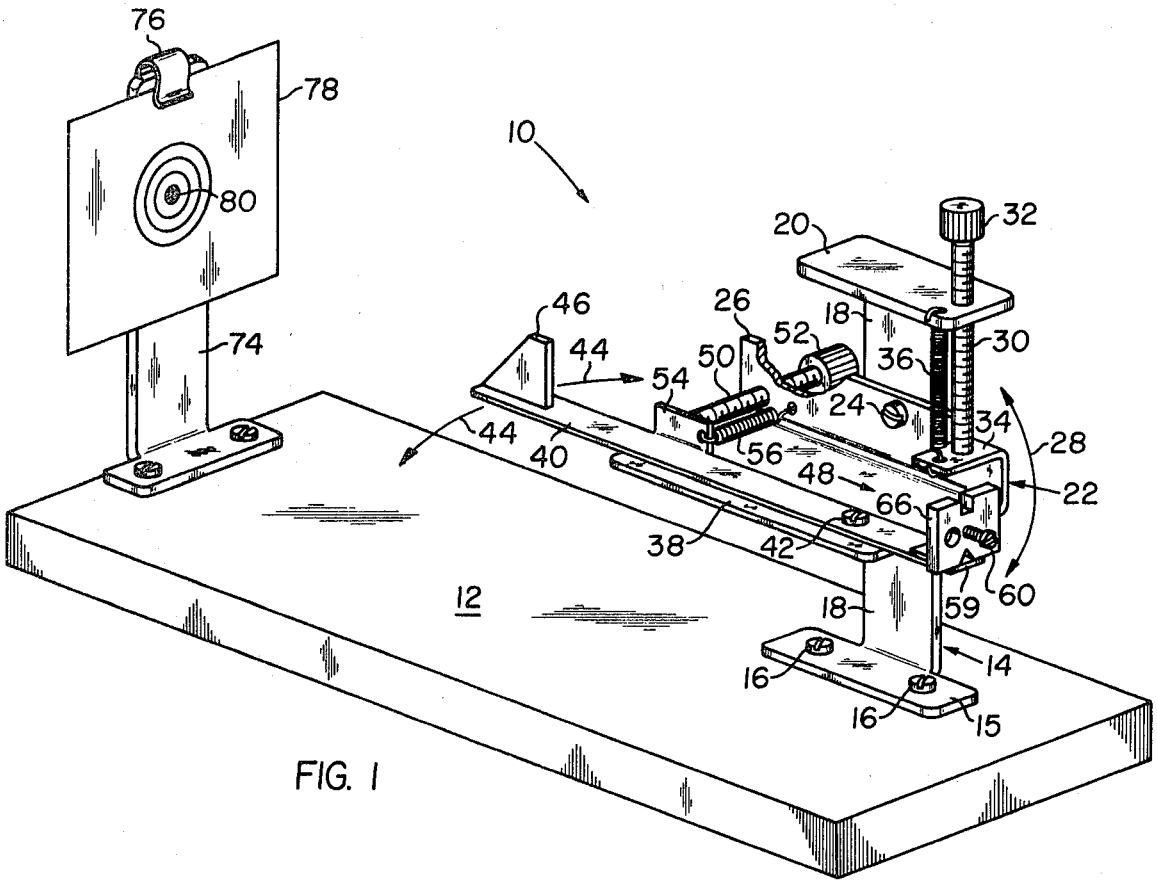
FIG. 1 is a perspective view of a firearm sight picture simulator and teaching aid constructed in accordance with the teaching of the present invention.

A firearm sight picture simulator and teaching aid constructed in accordance with the present invention is seen in FIG. 1 and designated by the general reference numeral 10. A base 12 mountably supports a frame member 14 fixedly secured at its foot 15 as by screws 16. The frame member 14 further comprises an upstanding portion or upright 18 extending substantially vertically from the foot 15 and terminating at a substantially horizontally depending header or platform 20.

An L-shaped bracket or support means generally designated 22 is connected with the frame member 14 for pivotal movement relative thereto and about a pivot point 24. The pivot point is seen to connect the substantially vertical leg 26 of the L-shaped bracket with the frame upright 18 and may comprise a rivet or screw as shown or any other connecting means permitting free axial movement of the bracket 22 relative to the frame and along a substantially vertical plane as indicated by the double-headed arrow 28 in FIG. 1.

An elevation adjusting screw 30 including an adjusting head or grip 32 is threaded through the header 20 such that rotational movement of the screw 30 causes the same to advance or retract through the header. The downwardly disposed end of the adjusting screw 30 abuttingly engages and bears against a ledge 34 normally depending from the bracket leg 26 for pivotally moving the bracket or support means 22 in response to rotation of the adjusting screw.

A resilient means such as the spring 36 tensibly connects the header 20 and the ledge 34 to maintain the separation therebetween as determined by the position of the screw 30. Thus, the pivotal position of the bracket 22 relative to the frame 14 is at all times maintained and free rotation of the bracket is prevented as the tensile force of the spring 36 pulls the ledge 34 toward the fixed header 20 while the adjusting screw 30 maintains the spaced apart relation of the same in opposition to the force of the spring. Those skilled in the art will of course recognize that an analogous structure wherein a compression spring forces apart the header and ledge and a suitably modified adjusting screw or the like presents further spaced apart separation thereof could be employed with like results and within the scope and contemplation of the invention.

The bracket leg 38 depending from the vertically disposed leg 26 carries and supports an elongated sight arm 40. The arm 40 is connected with the leg 38 at a pivot point 42 to render the sight arm pivotally movable about the pivot point 42 and relative to the bracket 22 in the manner denoted by the arrows 44. The plane along which the sight arm pivots is seen to be substantially perpendicular to the vertical plane along which the bracket 22 pivots. It will, therefore, be understood that the arm 40 is pivotally movable along two independent, substantially perpendicular planes.

It is intended that the sight arm 40 simulate the general arrangement of a firearm barrel and the arm thus carries proximate the opposite ends thereof forward sight means 46 and rear sight means 48. The particular configurations of the front and rear sights provided on the teaching apparatus 10 are not critical to the invention and, by way of example only, a patridge knife sight 46 is shown at the forward end of the arm 40 while an adjustably selectable rear sight means 48 which will be described in detail hereinafter is included at the rear end thereof.

A windage adjusting screw 50 having a grip or head 52 is rotatably threaded for controlled axial displacement through the vertical leg 26 of the L-shaped bracket 22. In much the same manner as the elevation adjusting screw 30 cooperatively abuts the ledge 34, the end of the screw 50 opposite its head 52 bears against a shoulder 54 depending from the sight arm 40. A return spring means 56 connected between the bracket leg 26 and the shoulder 54 serves to maintain the shoulder abuttingly against the end of the screw 50 and thereby prevents undesired pivotal movement of the sight arm 40.

Figure 2:
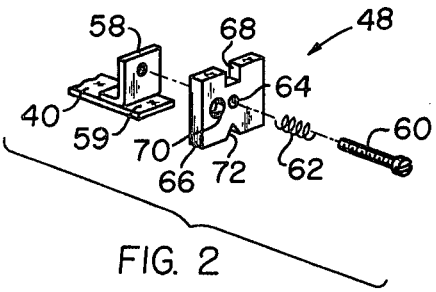
FIG. 2 is an exploded perspective view of the adjustable rear sight on the apparatus of FIG. 1.

The rear sight means 48 includes provision for selecting a desired rear sight configuration. As best seen in FIG. 2, the sight arm 40 carries an upstanding mounting bracket 58 adjacent the rear end thereof in such manner that a short locking portion or extension 59 of the arm 40 extends rearwardly beyond the mounting bracket 58. A screw 60 having a circumferentially encompassing compression spring 62 axially encircling the same is slidably journalled through an opening or passage 64 centrally defined in a rear sight member 66 and secured to the mounting bracket 58.

The rear sight member 66 is seen to be of square cross-sectional configuration and is provided with a square cut sight 68, a peep or aperture type sight 70, and a V-shaped sight 72 defined in the various peripheral surfaces thereof. While the member 66 may assume a wide variety of polygonal shapes for the purpose of providing a predetermined number of selected sighting apertures or slots, the same must have an even number of sides or edges of equal length to permit the selected sight to be positively held and locked in sighting position as will soon become clear.

The base 12 of the sight picture simulator and teaching apparatus 10 further carries a target support member or upright 74 which includes a retaining clip 76 for holding a target 78. The target may advantageously include the usual bull's-eye 80 for teaching purposes as will now be described.

In use, the apparatus 10 is first placed on a table or other supporting surface so as to position the same at a convenient, eye-level viewing height. Next, the rear sight is selected from those provided on the sight member 66 by rearwardly moving or pulling the member 66 against the force of the compression spring 62 so as to relese the downwardly disposed surface of the sight member from locking engagement with the sight arm extension 59. The sight member 66 may then be rotated so as to position the desired rear sight at the top thereof before releasing the member 66 and permitting the force of the spring 62 to return the sight member to its normally locked non-rotatable condition against the extension 59. For purposes of discussion, the square cut 68 has been selected as the rear sight to be used and it is so shown in the drawing.

The student or other user of the apparatus 10 may then sight along the arm 40 and through the rear and front sights 68 and 46 respectively to the bull's-eye 80 of the target 78. To effect movement of the sight arm 40 for the purpose of aligning the sights with the target, the student need merely selectively adjust the screws 30 and 50. Thus, selected rotation of the elevation adjusting screw 30 at its head 32 causes controlled pivotal movement of the bracket 22 to carry the sight arm 40 through corresponding movement along a substantially vertical plane. In other words, rotation of the screw 30 raises or lowers the sights relative to the bull's-eye of the target to adjust the elevation of the sight arm 40.

In like manner, rotating the head 52 of the windage adjusting screw 50 causes the sight arm 40 to move from side to side along a plane substantially perpendicular to the vertical movement effected by rotation of the elevation adjusting screw 30. Horizontal alignment of the sights 68 and 46 relative to the bull's-eye 80 is, therefore, effected by selective rotation of the windage adjusting screw 50.

Selective rotation of the adjusting screws 30 and 50 will be understood to adjust the pivotal position of the sight arm 40 along a pair of substantially perpendicular planes so as to represent or simulate the elevation and windage-adjusting movements necessary for properly aiming a firearm. As a consequence of the pivotal support of the arm 40 and of the L-shaped bracket 22 at positions intermediate the front and rear sights 46, 48, the elevation and windage adjustments performed by way of selected adjustment of the respective screws 30, 50 causes the sights 46, 48 to move relatively across the line of sight of each other along each of the two planes. Put another way, sighting through the sights 46, 48 while rotating the windage adjusting screw 50, one observes that one of the sights is moved to the right while the other sight is oppositely moved to the left relative thereto. The same relation holds true along the vertical plane for adjustment of the elevation adjusting screw 30.

Figure 3:
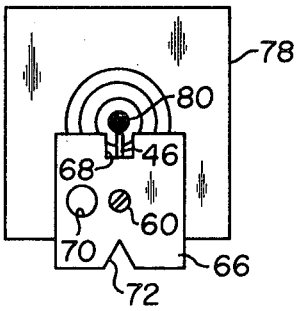
FIG. 3 is a view longitudinally along the sight arm of the apparatus of FIG. 1 illustrating proper sight picture alignment of the front and rear sights relative to a fixed target.

After the student has properly aligned the sights of the apparatus 10 with respect to the target, the alignment will remain fixed by reason of the provision of the springs 36 and 56 maintaining the pivotal positions of the bracket 22 and sight arm 40. An instructor can subsequently view the bull's-eye 80 through the rear and front sights carried on the sight arm 40 to determine whether the student has a correct understanding of the relationship between the sights and the bull's-eye of the target. Proper sight picture alignment, as shown in FIG. 3, requires that after the front sight 46 is aligned in the center of the rear sight 68, the bull's-eye 80 is made to appear to sit on top of the front sight 46 which in viewing position takes on the appearance of a post.

Thus, the apparatus of the present invention enables the student to adjust front and rear sights carried on a simulated firearm barrel for proper alignment with a fixed target. The adjusted position of the sights is maintained and prevented from inadvertently shifting so as to permit subsequent convenient and easy verification of the student's understanding of the concept of sight picture alignment.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In an apparatus for teaching firearm sight picture alignment, an elongated sight arm carrying front sight means and rear sight means relatively spaced along the length thereof so as to simulate the arrangement of a firearm barrel, said arm having movement along substantially perpendicular first and second planes so as to permit corresponding movement of said front and rear sight means, means for supporting said sight arm, first adjustable means operatively cooperating with said supporting means for moving the supporting means and said sight arm along the first plane and for automatically retaining said sight arm against further movement along the first plane when said sight arm is moved to a selected position therealong, and second adjustable means operatively cooperating with said supporting means and with said sight arm for moving said sight arm along the second plane relative to said supporting means and for automatically retaining said sight arm against further movement along the second plane when said sight arm is moved to a selected position therealong, the adjustment of said sight arm to said selected positions along the first and second planes being effected to enable one to properly align said front and rear sight means with respect to a remotely fixedly positioned target such that the resulting sight picture alignment may subsequently be inspected by another to determine the accuracy thereof by reason of the retention of said sight arm at said selectively adjusted positions by said first and second adjustable means, said supporting means being a bracket supporting said sight arm and arranged for pivotal movement along the first plane in response to operation of said first adjustable means for carrying said sight arm through selected pivotal movement along the first plane, said sight means being pivotally supported on said bracket for pivotal movement relative thereto along the second plane in response to operation of said second adjustable means and independent of the pivotal position of said bracket along the first plane.

2. In an apparatus according to claim 1, each of said first and second adjustable means including rotatable screw means operable for causing selected pivotal movement of said sight arm along the first and second planes respectively and spring means normally biasing said sight arm in opposition to said screw means for automatically retaining the pivotal position of said sight arm as the same is selectively adjusted by operation of said screw means.

3. In an apparatus according to claim 1, said rear sight means having a plurality of sighting openings defined thereon and being operatively adjustable for enabling the use of any one of said plural sighting openings in conjunction with said front sight means for adjustment of said sight arm with respect to the target.

4. In a firearm sight teaching apparatus, front and rear sights each movable along and crossing the line of sight of the other in two planes, means connecting said front and rear sights for said crossing movement, and operative means cooperating with said connecting means to move said front and rear sights along the two planes such that when one aligns said front and rear sights with each other and relative to a target said sights are automatically retained in such alignment until changed to enable another to determine whether the alignment of said sights is correct, said operative means including means supporting said connecting means to move said connecting means therewith in one of said two planes in accordance with said operative means and for movement of said connecting means relative to said supporting means in the other of said two planes, said connecting means being an elongated arm simulating the barrel of a firearm with said front and rear sights mounted thereon, means pivotally supporting said arm intermediate said front and rear sights mounted thereon to enable said arm to pivot in said two planes such that said front and rear sights cross each other in each of said planes of movement, said operative means including manually adjustable screw means connected with said arm to cause the same to pivot about said supporting means.

5. In an apparatus for teaching proper firearm sight picture alignment with respect to a fixed target, frame means positionally fixed at a predetermined location relative to a fixed target, support means pivotally connected with said frame means for selected movement relative thereto along a first plane, an elongated sight arm carrying front and rear sight means at substantially opposite ends along its length so as to simulate the arrangement of a firearm barrel, said sight arm being carried on said support means for movement therewith along the first plane and pivotally connected with said support means for selected movement relative thereto along a second plane substantially perpendicular to the first plane so as to permit alignment of said sight arm with the target in the manner of a firearm barrel, first adjustable means cooperating with said support means and operable for selectively pivotally moving the same along the first plane relative to said frame means to cause corresponding pivotal movement of said sight arm and for automatically maintaining the adjusted position of said sight arm as the same is pivotally moved along the first plane, and second adjustable means cooperating with said sight arm and operable for selectively pivotally moving the same along the second plane relative to said support means and for automatically maintaining the adjusted position of said sight arm as the same is pivotally moved along the second plane, such that while sighting the target through said front and rear sight means, said first and second adjustable means are independently selectively adjustable to adjust the pivotal position of said sight arm along the first and second planes respectively to enable one to properly align said sight arm and said front and rear sight means carried thereon with the target, the alignment of said sight arm with the target being subsequently observable by reason of the automatic maintenance of the adjusted pivotal position of said sight arm by said first and second adjustable means for determining whether proper sight picture alignment with respect to the target has been achieved.

6. In an apparatus according to claim 5, said first adjustable means comprising first spring means connected between said frame and support means and first selectively adjustable screw means cooperating with said support means in opposition to said first spring means for effecting selected pivotal movement of said sight arm along the first plane, and said second adjustable means comprising second spring means connected between said sight arm and support means and second selectively adjustable screw means cooperating with said sight arm in opposition to said second spring means for effecting selected pivotal movement of said sight arm along the second plane.

7. In an apparatus according to claim 6, said first screw means being rotatively journalled through said frame means and having an end bearing against said support means and extendably adjustable relative to said frame means for effecting selected pivotal movement of said support means along the first plane and corresponding pivotal movement of said sight arm carried thereon as said first screw means is selectively rotated relative to said frame means, and said second screw means being rotatively journalled through said support means and having an end bearing against said sight arm and extendably adjustable relative to said support means for effecting selected pivotal movement of said sight arm along the second plane as said second screw means is rotated relative to said support means.

8. In an apparatus according to claim 5, said rear sight means including a plurality of predeterminately configured sighting openings and being adjustably carried on said sight arm such that any one of said plural sighting openings may be utilized in conjunction with said front sight means for sighting the target.

9. In an apparatus according to claim 5, said first plane being substantially vertically disposed.

* * * * *